US005193229A

United States Patent [19]

Smith

[11] Patent Number: 5,193,229

[45] Date of Patent: Mar. 16, 1993

[54] CUSHIONED TOILET SEAT COVER FOR THE ELDERLY

[76] Inventor: Robert R. Smith, 584 Shenandoah Trail, Elgin, Ill. 60123

[21] Appl. No.: 651,324

[22] Filed: Feb. 5, 1991

[51] Int. Cl.[5] ..... A47K 13/14

[52] U.S. Cl. ..... 4/245.5

[58] Field of Search ..... 4/242, 243, 234

[56] References Cited

U.S. PATENT DOCUMENTS

| | | | |
|---|---|---|---|
| 1,088,090 | 2/1914 | Quackenbush | 4/242 |
| 1,159,070 | 11/1915 | Munch | 4/243 |
| 1,530,424 | 3/1925 | Shollar | 4/242 |
| 1,575,640 | 3/1926 | Ragland . | |
| 2,611,136 | 9/1952 | Diamond | 4/242 |
| 2,706,767 | 4/1955 | Packchanian | 4/242 X |
| 2,773,167 | 12/1956 | Arbaugh | 4/242 X |
| 2,858,549 | 11/1958 | Carson | 4/242 |
| 3,331,085 | 7/1967 | Potsosky . | |
| 3,379,800 | 4/1968 | Wert . | |
| 3,517,396 | 6/1970 | Wert . | |
| 3,587,119 | 6/1971 | Freeses . | |
| 3,639,922 | 2/1972 | Samuels et al. . | |
| 3,653,076 | 4/1972 | Warnberg | 4/242 X |
| 3,671,981 | 6/1972 | Smith . | |
| 3,874,008 | 4/1975 | Warnberg . | |
| 3,988,789 | 11/1976 | Blount . | |
| 4,130,906 | 12/1978 | Robertson | 4/242 |
| 4,227,267 | 10/1980 | Robertson . | |
| 4,586,202 | 5/1986 | Uchida . | |

FOREIGN PATENT DOCUMENTS

| | | | |
|---|---|---|---|
| 2176216 | 12/1986 | United Kingdom | 4/242 |

*Primary Examiner*—Charles E. Phillips

*Attorney, Agent, or Firm*—Thomas E. Schatzel

[57] ABSTRACT

A removable toilet seat cover comprising deep pile carpet for cushioning of the rim of a rigid toilet seat and elastic bands that aid the elderly in positioning the cover on a seat for securing by the closing of overlapping flaps equipped with VELCRO®-type fabric hook-and-link fasteners.

3 Claims, 3 Drawing Sheets

CUSHIONED TOILET SEAT COVER FOR THE ELDERLY

BACKGROUND OF THE INVENTION

1. Field of the Invention

The invention relates generally to devices that aid the elderly and more specifically to devices that attach to a toilet seat to relieve pain and discomfort in the upper posterior thigh and buttocks areas while seated.

2. Description of the Prior Art

The elderly are afflicted with numerous problems associated with the deterioration of skin, muscle, and bone commensurate with old age that can make ordinary and routine activities painful and uncomfortable. Slow healing skin sores, a loss of skin elasticity, wasting of muscle, and a loss of the fatty layer between the skin, muscle and bone can place exaggerated pressures on brittle bones and sensitive nerves. In particular, ordinary toilet seats have sharply defined areas of support that can seem to cut into the thighs along sharp edges and cause discomfort. Some toilet seat covers have been developed in the prior art, but these address different problems and can be very difficult for the weak and often unsteady hands of the elderly to install and remove.

A water closet seat cover is described by Warnberg in U.S. Pat. No. 3,874,008, issued Apr. 1, 1975. A flexible cover carries eyelets or apertures suitable for engaging downwardly projecting anchor members that are secured to the seat. The outer peripheral edge of the flexible cover is slotted to pass hinge arms so that the cover can be drawn taut over the entire upper surface of the seat, and thus provide for a neat and aesthetic appearance. An object of the Warnberg seat cover is to provide a method for quickly mounting and positioning a flexible, aesthetic cover on the rigid toilet seat used in water closet construction so that the inclusion of an annular stiffening ring secured to the inner periphery of the flexible cover is not needed.

A second cover for a water closet seat is described by Robertson in U.S. Pat. No. 4,227,267, issued Oct. 14, 1980. A cover for a water closet seat includes an annular panel of flexible fabric having an inner peripheral edge and an outer peripheral edge, and adapted to fit across and to cover the upper surface of a water closet seat. A band of resilient material is mounted at and around the outer peripheral edge of the panel and constrictively urges the outer peripheral edge to a contracted, converged position. A hem channel is carried by the panel at its inner periphery, and is transversely crossed by a channel closure that blocks the channel at a point around the periphery. A channel opening is provided at a location spaced along the hem channel. A two-ended, resilient stiffening member is positioned in the channel with the two ends abutting the channel closure.

Earlier, U.S. Pat. No. 1,575,640, was issued to Ragland, on Mar. 9, 1926, for a toilet seat cushion. The cushion adjusted to accommodate seats of various diameters and secured to a seat with shoelace-style ties that are knotted under the seat. The cushion has a padded material that is stuffed within the cushion's leather panels.

On Jul. 18, 1967, U.S. Pat. No. 3,331,085 issued to Potosky for an auxiliary toilet seat. The stated disadvantages of the prior art were the problem of sanitation, particularly in public toilet areas, and the creation or aggravation of physical ailments. The shape and the hardness of a standard toilet seat is taught to place an extreme amount of pressure on both sides of the gluteal region. The problems of hardness of the standard toilet seat causes particular discomfort to the aged. An object was to provide a seat which is sanitary, soft, easily portable, and properly shaped to avoid discomfort and aggravation. The auxiliary seat has a central stiffening core in a horseshoe shape with a vinyl foam cushion fitted over the top. A similar cushion is fitted over the bottom surface of the stiffening core. The cushion are wider than the stiffening core and are cemented together along their overlapping margins. The entire surface of the auxiliary seat assembly is coated with a suitable vinyl or latex film that is moisture resistant and provides a smooth and easily cleaned surface.

The prior art, in general, does not offer the textures and cushioning conducive to the elderly user and are universally difficult to install and remove by someone with limited dexterity.

SUMMARY OF THE PRESENT INVENTION

It is therefore an object of the present invention to provide a toilet seat cover that is comfortable for the elderly to use.

It is therefore an object of the present invention to provide a toilet seat cover that is easy for the elderly to install and remove.

Briefly, a removable toilet seat cover comprises a panel of deep-pile carpet for cushioning the rim of a rigid toilet seat and has elastic bands that aid the elderly in positioning the cover on a seat for securing by the closing of overlapping flaps equipped with VELCRO® -type fabric hook-and-link fasteners.

An advantage of the present invention is that it is comfortable for the elderly to use.

Another advantage of the present invention is that it is easy for the elderly to install and remove. This makes it simpler to launder.

Another advantage of the present invention is that it is inexpensive to manufacture.

Another advantage of the present invention is that it has an obvious way that it must be installed and removed.

These and many other objects and advantages of the present invention will no doubt become obvious to those of ordinary skill in the art after having read the following detailed description of the preferred embodiments which are illustrated in the various drawing figures.

IN THE DRAWINGS

Figure 5:
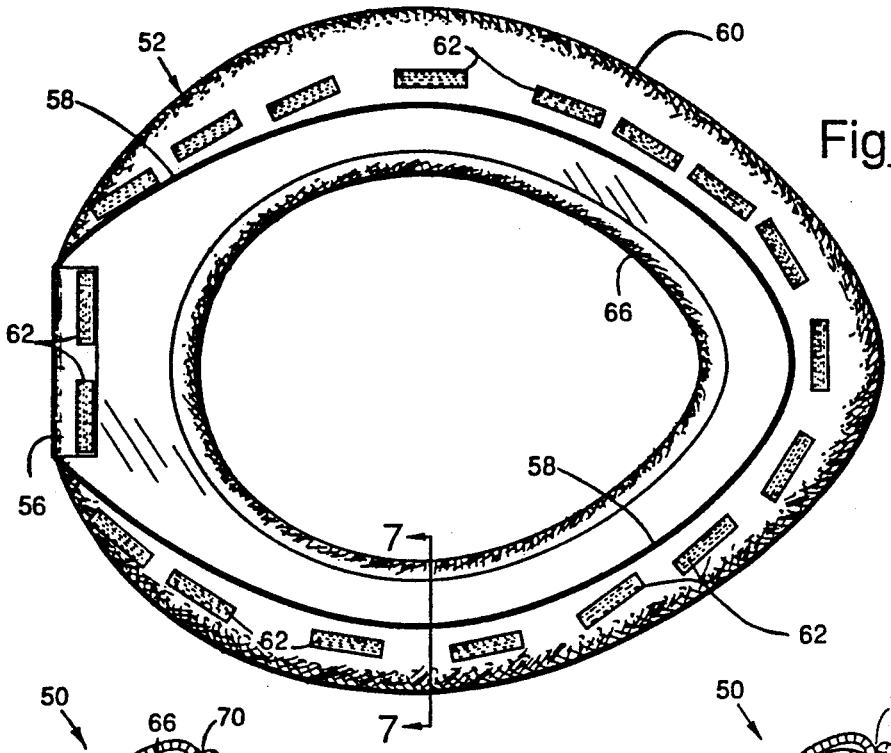
FIG. 5 is a bottom elevational view of an upper assembly of a second embodiment of a cover and is shown prepositioned on a toilet seat but not secured to it by a lower assembly.
Figure 7:
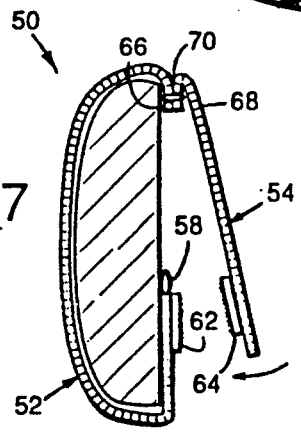
Figure 6:
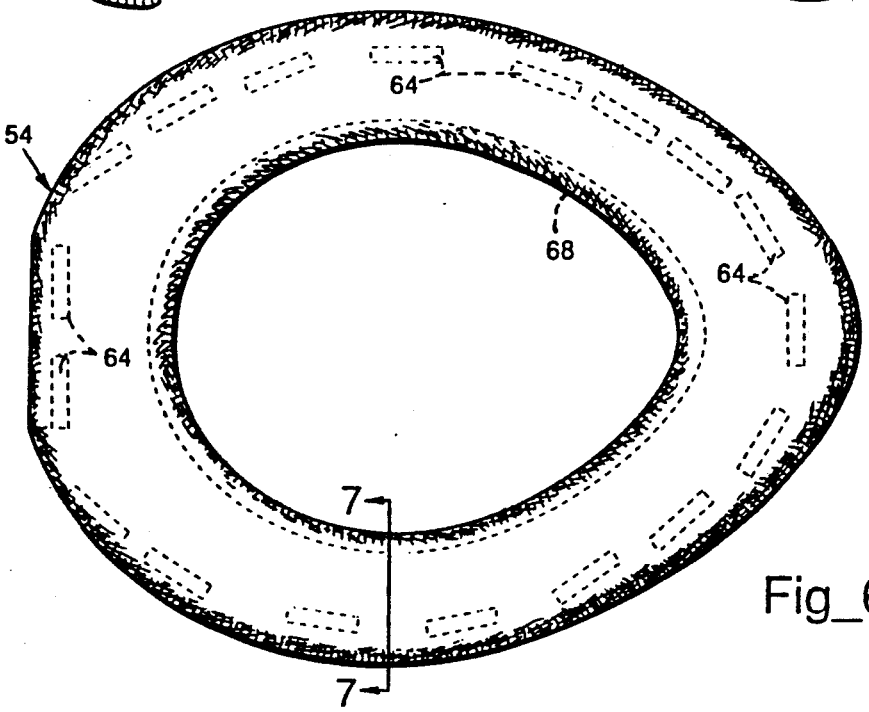
FIG. 6 is a bottom elevational view of the lower seat cover assembly that matches to the upper seat assembly of FIG. 5. The lower assembly is stitched to the upper assembly and are shown here separated from each other for the sole purpose of clarifying the construction of the second embodiment.

FIG. 7 is a cross sectional view of the seat cover and seat of FIGS. 5 and 6 taken along the line 7—7. The upper and lower cover assemblies are shown joined at their respective inside flaps as per their usual construction. FIG. 5 contributes the cross-section of the upper assembly and FIG. 6 contributes the cross-section of the lower assembly to FIG. 7; and FIG. 8 repeats the cross-sectional view of FIG. 7, but with the lower assembly now secured to the upper assembly by VELCRO devices in a final installation configuration.

DETATIED DESCRIPTION OF THE PREFERRED EMBODIMENTS

Figure 1:
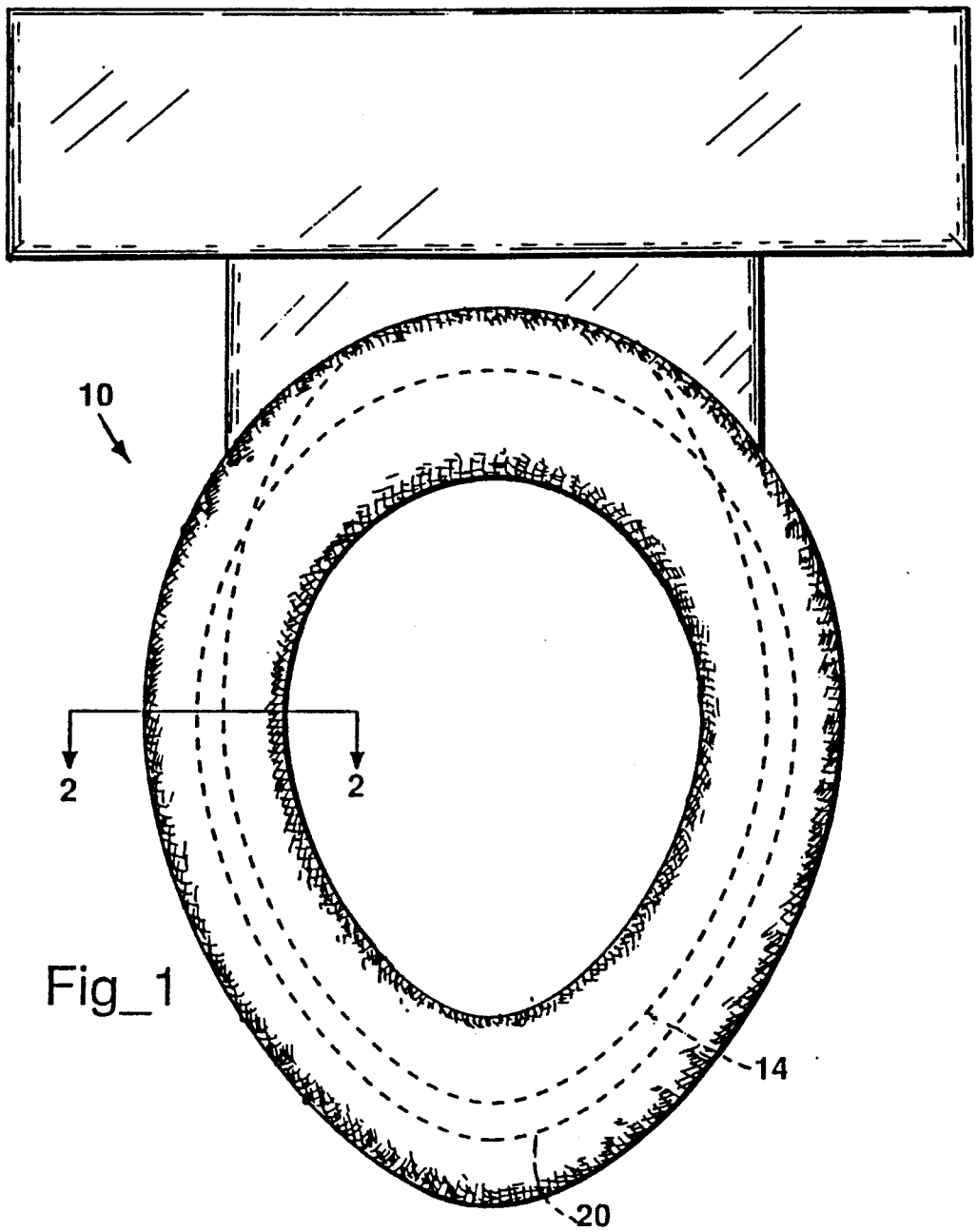
FIG. 1 is a top elevational view of a water closet and toilet seat fitted with a first embodiment seat cover.

FIG. 1 illustrates a water closet having a toilet seat cover, referred to by the general reference number 10, comprising a panel 12, an outer perimeter elastic 14, a first fabric hook-and-link fastener 16, a second fabric hook-and-link fastener 18, and an inner perimeter elastic 20. Panel 12 is preferably a section of deep-pile carpet having a non-slip backing. The pile may be short or long loop, cut, etc. The pile may be selected on a case-by-case basis for individual preferences. Panel 12 has carpet piles that are preferably a bright color, so as not to appear as some medical apparatus. The present inventor has tried a deep green and a bright red color with good results. The material of panel 12 should be washable and not easily stained. Elastics 14 and 20 are continuous elastic bands held in place in panel 12 by fabric loops (not shown). The first and second fabric hook-and-link fasteners 16 and 18 are preferably matching pieces of VELCRO® -type fastening devices. (VELCRO is a trademark of a widely known and universally commercially available fastener commonly used to close shoes, jackets, wallets, and other articles that have traditionally used zippers, buttons, and laces.) These types of devices provide an closing and opening method that is simple and easy to accomplish by elderly persons with poor hand mobility/dexterity, and who usually have poor eyesight. Elastic 14 is preferably sewn onto panel 12 such that panel 12 is gathered at its outside perimeter and will cause cover 10 to grip a standard seat. Alternatively, elastic 14 is not continuous and follows a horseshoe-shaped path in panel 12. An opening in panel 12 and an absence of fold-over flaps in the area of the opening, together with the open part of the horseshoe path of elastic 14 allow room for standard toilet seat hinges to attach the seat to the water closet. Cuts orthogonal to the inner and outer perimeters of panel 12 are preferably made from the perimeter edges one or two inches deep toward the middle. Alternatively, triangular shaped cuts may be made such that triangular sections of panel 12 are removed during the cutting. The cuts will help cover 10 (which comprises panel 12 that has been cut from a flat piece of relatively inelastic material) conform to the three-dimensional shape of the standard seat.

Figure 2:
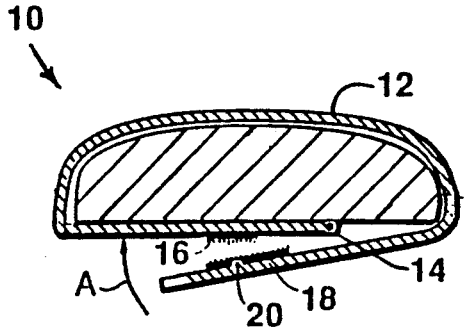
FIG. 2 is a cross-sectional view of the seat and cover of FIG. 1 taken along the line 2—2.

In FIG. 2, the outside edge of the seat is shown at the left of the cross-section. Elastic 14 is first stretched over the seat such that a pocket forms to grip the seat and preposition cover 10. Once cover 10 has been prepositioned, a flap on panel 12 that carries elastic 18 and fastener 18 can be moved in direction "A", such that fastener 18 contacts fastener 16. To remove cover 10, the overlapping flap is pulled back toward the inside perimeter of the seat, one flap at a time. Elastic 20 helps keep neighboring flaps of panel 12 together and can help prevent a single loose flap from dropping into the waters and thereby becoming inadvertently soiled.

Figure 3:
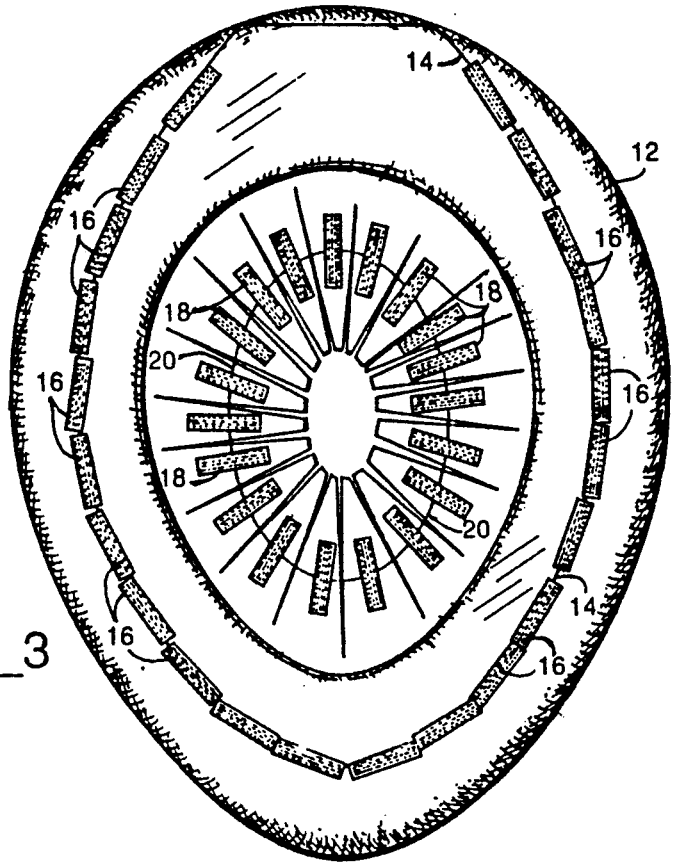
FIG. 3 is a bottom elevational view of the cover of FIG. 1 prepositioned on the seat but not secured to it by the inner flaps.
Figure 4:
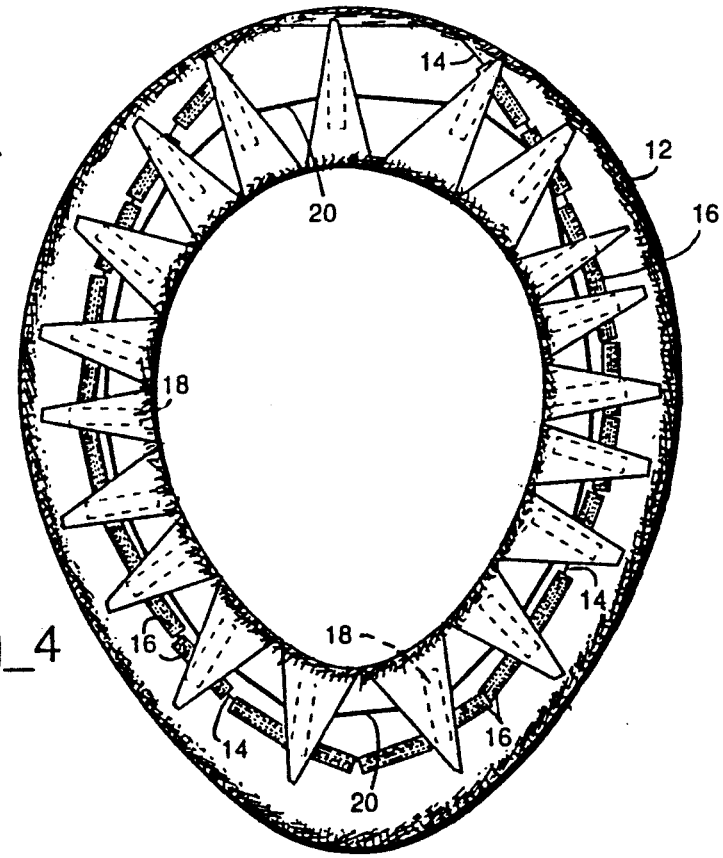
FIG. 4 is a bottom elevational view of the cover of FIG. 1 secured to the seat and having the flaps closed in their secure positions.

FIGS. 3 and 4 illustrate the action of the inner flaps and how they secure cover 10 to the seat. FIG. 3 shows all the inner flaps in their prepositioning positions. The pocket formed by panel 12 and elastic 14 grips the seat. In FIG. 4, the flaps and fasteners 18 have been one by one lifted over to meet with fasteners 16 and to be secured by the meeting. Should a flap become loose because its respective fasteners 16 and 18 have parted, the flap will not droop into the waters because elastic 20 will tend to resist a vagrant action.

Figure 8:
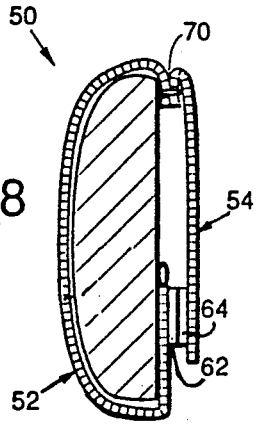

FIGS. 5–8 show a second embodiment seat cover 50 that comprises an upper assembly 52 and a lower assembly 54. Upper assembly 52 has a cross section of a C-shape at all points except its rear where it has a back flap 56, an elastic tightener 58 is secured to a severed edge of the upper assembly to define a pocket 60, a plurality of first VELCRO devices 62 are attached to the upper assembly in board of the elastic tightener 58 and corresponding second VELCRO devices 64 are attached along a second edge on lower assembly 54, and an upper inside stitch flap 66 that attaches to a matching lower inside stitch flap 68 of a first edge on the lower assembly 54. Flaps 66 and 68 are stitched together to form a continuous seam 70. (FIGS. 5 and 6 do not show seam 70 or the joining of assemblies 52 and 54 for clarity of this disclosure only.) Preferably, upper and lower assemblies 52 and 54 comprise soft fabrics that are easy to launder, such as a plush commonly used for stuffed toy animals. (In one sense, the plush fabric simulates the look and feel of soft fur.) For aesthetic reasons, the material of upper assembly 52 ought to match that of lower assembly 54. To install seat cover 50, first and second VELCRO devices 62 and 64 are separated and lower assembly 54 is pushed through the opening of a toilet seat from the top. Pocket 60 is slipped over the seat and flap 56 is threaded between hinges that attach to the seat. The second VELCRO devices 64 are pulled over to respective seat, as shown in FIG. 8 with the tightener 58 intermediate the edge of the lower assembly. Once all the VELCRO devices 62 and 64 are joined, seat cover 50 will be securely fastened to the seat and will be ready for use. Removal of seat cover 50 is done by simply reversing the installation steps.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

I claim:

1. A toilet seat cover for use on an oval shaped toilet seat having a center opening and being attached at its rear to a toilet bowl hinge structure comprising:

an upper assembly having a C-shaped cross-section at all places except its rear, with a first edge of said C-shape facing a second edge of said C-shape with a gap therebetween forming a pocket to receive and hug said toilet seat, the upper assembly having an upper surface extending in a plane corresponding to said oval shape with a central opening and an elastic tightener attached to said second edge of said C-shape along its entire length except for a rear portion;

a lower assembly having a planar surface bounded by a first and second edge defining a surface corresponding to said oval shape with a first edge of the lower assembly continuously joined to said first edge of the upper assembly; and fabric hook and link securing means, one of said hook and link being attached along said second edge of the upper assembly inboard and adjacent to said elastic tightener and the other of said hook and link being attached along said second edge of the lower assembly, the securing means providing for positioning the lower assembly across said gap such that the toilet seat is enclosed within the toilet seat cover and the securing means securely holds the upper and lower assemblies in place on the toilet seat about said oval shape plane with said elastic tightener positioned intermediate said first and second edges of the lower assembly.

2. The cover of claim 1, wherein:

the upper assembly includes a flap at its rear for positioning between hinges on a toilet seat such that the upper assembly can cover substantially all of the upper surface area of the seat.

3. The cover of claim 1, wherein:

the upper and lower assemblies comprise a plush fabric material with a fur-like texture and appearance.

* * * * *